US005516692A

United States Patent [19]

Berndt

[11] Patent Number: 5,516,692

[45] Date of Patent: May 14, 1996

[54] COMPACT BLOOD CULTURE APPARATUS

[75] Inventor: Klaus W. Berndt, Stewartstown, Pa.

[73] Assignee: Becton Dickinson and Company, Franklin Lakes, N.J.

[21] Appl. No.: 358,642

[22] Filed: Dec. 19, 1994

Related U.S. Application Data

[63] Continuation of Ser. No. 10,913, Jan. 29, 1993, abandoned.

[51] Int. Cl.[6] ..... C12M 1/34

[52] U.S. Cl. ..... 435/286.7; 422/63; 422/68.1; 422/82.05; 435/288.1; 435/288.7; 435/303.3

[58] Field of Search ..... 422/63, 82.05, 422/82.08, 82.09, 68.1; 436/45, 47, 682, 807–809; 435/284, 291, 312, 316, 286.7, 288.1, 288.7, 304.1, 303.3, 808; 356/73, 317–318, 417, 435–436, 442

[56] References Cited

U.S. PATENT DOCUMENTS

| | | | |
|---|---|---|---|
| 3,926,733 | 12/1975 | Chibata et al. | 435/34 |
| 3,928,140 | 12/1975 | Wyatt et al. | 435/291 X |
| 4,101,383 | 7/1978 | Wyatt et al. | 195/103.5 R |
| 4,152,213 | 5/1979 | Ahnell | 195/103.5 M |
| 4,372,683 | 2/1983 | Sternberg | 356/388 |
| 4,576,916 | 3/1986 | Lowke et al. | 435/289 |
| 4,669,878 | 6/1987 | Meier | 356/319 |
| 4,672,038 | 6/1987 | Jaekel et al. | 435/291 |
| 4,826,660 | 5/1989 | Smith et al. | 422/68 |
| 4,871,676 | 10/1989 | Yamada | 435/290 |
| 4,877,747 | 10/1989 | Stewart | 436/525 |
| 4,889,992 | 12/1989 | Hoberman | 250/343 |
| 4,940,332 | 7/1990 | Miwa et al. | 356/417 |
| 4,945,060 | 7/1990 | Turner et al. | 435/291 |
| 4,952,498 | 8/1990 | Waters | 435/34 |
| 4,971,900 | 11/1990 | Ahnell et al. | 435/29 |
| 5,110,743 | 5/1992 | Windisch et al. | 436/48 |
| 5,134,623 | 7/1992 | Egawa et al. | 372/31 |
| 5,154,896 | 10/1992 | Mochida et al. | 422/209 |
| 5,155,019 | 10/1992 | Sussman et al. | 435/34 |
| 5,164,597 | 12/1992 | Lodder | 435/291 X |
| 5,308,506 | 5/1994 | McEwen et al. | 422/72 X |

OTHER PUBLICATIONS

Thorpe et al., "BacT/Alert: an Automated Colorimetric Microbial Detection System," Journal of Clinical Microbiology, Jul. 1990, pp. 1608–1612.

*Primary Examiner*—Robert J. Warden
*Assistant Examiner*—Krisanne M. Thornton
*Attorney, Agent, or Firm*—Alan W. Fiedler

[57] ABSTRACT

The present invention relates to an apparatus for detecting biological activities in a large number of blood culture vials. The vials are placed in discrete disc-like segments and rotated about an axis of a drum. In one preferred embodiment, agitation results from placing the axis of rotation perpendicular to the force of gravity. The present invention allows for individual vial identification, and for the application of more than one non-invasive microorganism detection method including fluorescence and scattered photon migration. Only a single detection station for each method is required for each segment and a plurality of stations may share common components, reducing cost while increasing accuracy. The vials may be inserted into a segment using a quick disconnect method and a keying method is disclosed to guarantee the correct orientation of a vial once it is inserted.

27 Claims, 11 Drawing Sheets

COMPACT BLOOD CULTURE APPARATUS

This application is a continuation of application Ser. No. 08/010,913, filed Jan. 29, 1993 now abandoned.

BACKGROUND OF THE INVENTION

The present invention relates to a non-invasive apparatus for detecting biological activities in a specimen such as blood, where the specimen and a culture medium are introduced into a large number of sealable containers and then exposed to conditions enabling a variety of metabolic, physical, and chemical changes to take place in the presence of microorganisms within the sample.

The presence of biologically active agents such as bacteria in a patient's body fluid, especially blood, is generally determined using blood culture vials. A small quantity of blood is injected through an enclosing rubber septum into a sterile vial containing a culture medium. The vial is incubated at 37° C. and monitored for microorganism growth.

One of the techniques used to detect the presence of microorganisms includes visual inspection. Generally, visual inspection involves monitoring the turbidity or eventual color changes of the liquid suspension of blood and culture medium. Known instrumental methods detect changes in the carbon dioxide content of the culture bottles, which is a metabolic by-product of the bacterial growth. Monitoring the carbon dioxide content can be accomplished by methods well established in the art, such as radiochemical or infrared absorption at a carbon dioxide spectral line. Until now, these methods have required invasive procedures of the vial which results in the well-known problem of cross-contamination between different vials.

It has also been proposed to detect microorganism growth in sealable containers by monitoring positive and/or negative pressure changes.

Recently, non-invasive methods have been developed involving chemical sensors disposed inside the vial. These sensors respond to changes in the carbon dioxide concentration by changing their color or by changing their fluorescence intensity. (See, e.g., Thorpe, et al. "BacT/Alert: An Automated Colorimetric Microbial Detection System", J. Clin. Microbiol., July 1990, pp. 1608–12, and U.S. Pat. No. 4,945,060, Turner, et al., the disclosures of which are incorporated by reference). In known automated non-invasive blood culture systems, individual light sources, spectral excitation/emission filters, and photodetectors are arranged adjacent to each vial. This results in station sensitivity variations from one vial to the next. Therefore, extensive and time-consuming calibration procedures are required to operate such systems. In addition, flexible electrical cables are required to connect the individual sources and detectors with the rest of the instrument. With the large number of light sources, typically 240 or more per instrument, maintenance can become very cumbersome and expensive when individual sources start to fail.

In known colorimetric or fluorometric instruments, light emitting diodes ("LEDs") are used as the individual light sources. These sources have only a relatively low optical output power. Therefore, a high photometric detection sensitivity is required to monitor the vial sensor emissions. This results in additional and more complicated front-end electronics for each photodetector, increasing production cost. To reduce equipment cost and complexity, it has been proposed to use optical fibers at each vial to feed the output light of an instrument's sensors to a central photodetector. A disadvantage to this approach is the need for arranging a large number of relatively long fibers of different length within the instrument.

In known automated non-invasive blood culture systems, no vial identification is provided within the instrument. Instead, microbiology lab personnel are required to execute a manual log-in for each vial. Besides being time-consuming, this step generates a certain probability for mistakes.

SUMMARY OF THE INVENTION

The present invention comprises a compact blood culture apparatus for detecting biologically active agents in a large number of blood culture vials that is simple and can be produced at very low cost. It incorporates individual vial identification and the application of more than one microorganism detection method within a single instrument. The inventive apparatus provides low system sensitivity variations from one vial station to the next and does not require electronic or optoelectronic components, electrical wires, or optical fibers on a moving vial rack. As a result of these several advantages, it has long-term reliability in operation.

A culture medium and blood specimen are introduced into sealable glass vials with optical sensing means and a bar code pattern for individual vial identification. A large number of such vials are arranged radially on a rotatable drum within an incubator which is used to promote microorganism growth. Sensor stations are mounted to the mainframe of the blood culture apparatus at such a distance from the drum that during its rotation, individual vials pass through a sensor station.

In a first embodiment of an apparatus according to the present invention, the inner bottom of each vial includes a fluorescent chemical sensor, and a linear bar code label is attached to one side. The vials are arranged radially on a rotatable drum within an incubator, with the vial necks oriented towards the drum axis of rotation. A preferred arrangement of the vials on the drum is to group the vials using disk-like segments. This approach facilitates vial insertion and removal. A lower portion of each vial extends radially outwardly from the outer peripheral surface of the drum, and the bar code label is positioned on this lower portion to facilitate scanning.

For each disk-like segment, at least one sensor station is required. If two or more detection principles are applied, then two or more sensor stations per segment are necessary. In addition to the sensor stations, the instrument comprises one bar code reader per segment.

The drum is driven by a stepper motor which is mounted to the instrument mainframe. The motor and the drum are connected via a toothed drive belt. In one preferred embodiment, the actual orientation of the drum is monitored by means of an angular decoder.

A first detection principle which may be used involves fluorescence intensity changes from a fluorescence chemical sensor spread along a bottom inner surface of each vial. Each fluorescence sensor station comprises an excitation light source, a light divider for dividing the excitation light into two components, an optical condenser system made up of a plurality of lenses to direct the excitation light or resulting fluorescence light, a light source monitor, and a fluorescence light collector. The first component of the excitation light is directed toward the light source monitor while the second component is directed toward the fluorescence chemical sensor. The fluorescence light from all of the fluorescence sensor stations are fed to a central photomultiplier.

If scattered photon migration ("SPM") is used as a second or alternative detection principle, each SPM sensor station comprises an excitation light source, a beam splitter, a monitor photodiode, a collection prism, and a collection fiber. The beam splitter divides the excitation light into two components. One component is directed toward the vial side and the other component is directed toward the monitor photodiode. SPM light reemerging from the opposite vial side is deflected toward the collection fiber by means of the collection prism. The collection fibers of all SPM sensor stations are fed to a second central photomultiplier. If the emission of the fluorescent chemical sensor occurs at a wavelength close to the optimum SPM wavelength, then the collection fibers of all SPM sensor stations can be fed to the central fluorescence photomultiplier.

To read the bar code labels, one diode laser per segment is mounted to the mainframe. The beam of the laser is focused by a long-focal-length optical system onto the bar code label of a vial. An optimum angle of incidence is approximately 45 degrees. Laser light back-scattered from the bar code label is detected by means of a photodetector. During rotation of the drum, all vials of a disk-like segment are passing the focused diode laser beam, thus allowing for bar code read-out.

In a preferred embodiment for an apparatus according to the present invention, the drum axis is oriented approximately horizontally so that the force of gravity may be used to agitate the medium/blood mixture as the drum rotates. As a result, no separate agitation mechanism is required.

Due to the arrangement of the vials on the drum, the spatial packaging density is relatively high. Consequently, an apparatus according to the present invention can be built compact and at a smaller size compared to existing blood culture systems. This is of particular interest with lab space in hospitals being a critical issue.

BRIEF DESCRIPTION OF THE DRAWINGS

The various inventive aspects of the present invention will become more apparent upon reading the following detailed description of the preferred embodiments along with the appended claims in conjunction with the drawings, wherein reference numerals identify corresponding components, and:

DETAILED DESCRIPTION OF THE PREFERRED EMBODIMENTS

Figure 1:
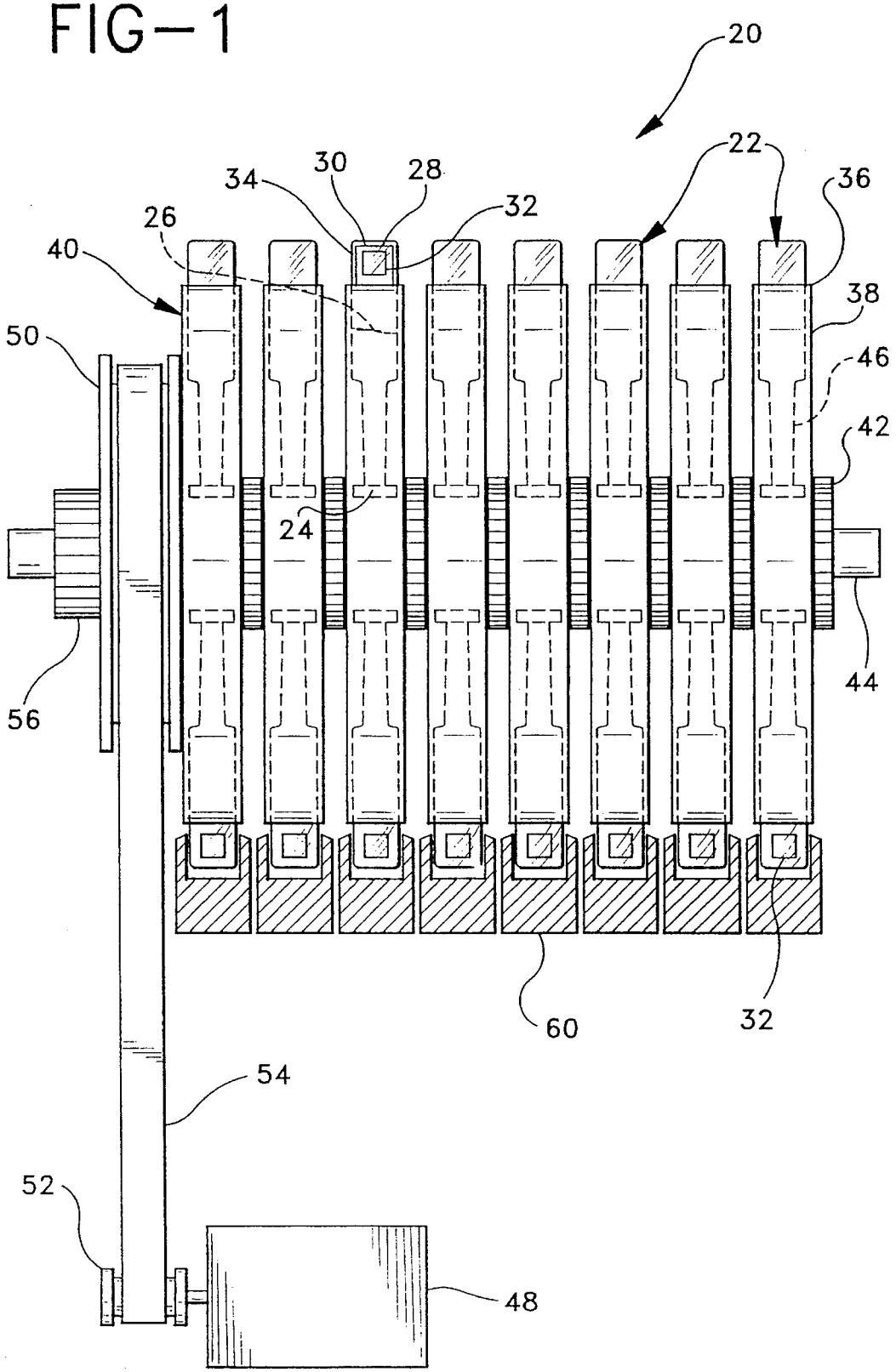
FIG. 1 shows a schematic front view of a compact blood culture apparatus for the detection of microorganisms according to the present invention, with an embodiment comprising eight disk-like drum segments.

A compact blood culture apparatus 20 embodying the principles and concepts of the present invention is depicted schematically in FIG. 1. Apparatus 20 comprises a plurality of glass vials 22, each sealed with a septum 24 and containing a medium/blood mixture 26. Each vial 22 contains a fluorescence chemical sensor 28 disposed on an inner bottom surface 30, and a linear bar code label 32 positioned on a lower portion 34. Lower portion 34 extends radially outwardly from an outer peripheral surface 36 of disk-like segments 38 of a drum 40 to facilitate scanning of each label 32. Segments 38 are separated by spacers 42 and mounted to a shaft 44.

In one preferred embodiment, shaft 44 is oriented horizontally. Vials 22 are oriented with their necks 46 toward drum axis represented by shaft 44. In this way, the force of gravity efficiently agitates medium/blood mixture 26 as drum 40 rotates. However, the present invention is not limited to an apparatus with such an orientation. For example, shaft 44 can also be oriented at an angle of 45 degrees relative to horizontal. In this case, it is advantageous to arrange vials 22 at an angle of 45 degrees relative to shaft 44. The net effect is that no upside-down orientation of the vials occurs. Each individual vial shifts between a horizontal and a vertical orientation.

It is also possible to mount the drum with its axis vertically oriented. Additional agitation is required, however, because the gravity action is lost. To avoid mechanical instability problems for apparatus 20 as a whole, it is possible to agitate the drum segment-wise, or to agitate the segments contrarily.

Rotation of drum 40 is accomplished by a stepper motor 48 which is connected to the drum via toothed drive pulleys 50 and 52, and a toothed drive belt 54. Drum 40 is arranged within an incubator 82, shown in FIG. 2, to promote microorganism growth within vials 22. The actual orientation of drum 40 is monitored through the use of a location positioner such as an angular encoder 56 mounted to shaft 44.

A plurality of sensor stations 60 are secured to a portion of apparatus 20 at such a distance from drum 40 that, during its rotation, individual vials 22 pass through a sensor station 60. For each disk-like segment 38, at least one sensor station 60 is required. If two or more detection principles are applied, then two or more sensor stations per segment 38 are necessary.

As discussed further, below, segments 38 do not contain electronic or optoelectronic components, and no flexible electrical cables or optical fibers are required. Therefore, an apparatus according to the present invention can be produced at reduced cost compared to existing blood culture instruments. The drum concept allows for high density packaging, particularly with neck 46 disposed into segment 38. The inventors have determined that this arrangement increases package density by a factor of approximately two and a half when compared to prior art devices. Therefore, smaller instruments can be built. By varying the number of disk-like drum segments 38, instruments with small, medium, or large vial numbers are possible.

Figure 2:
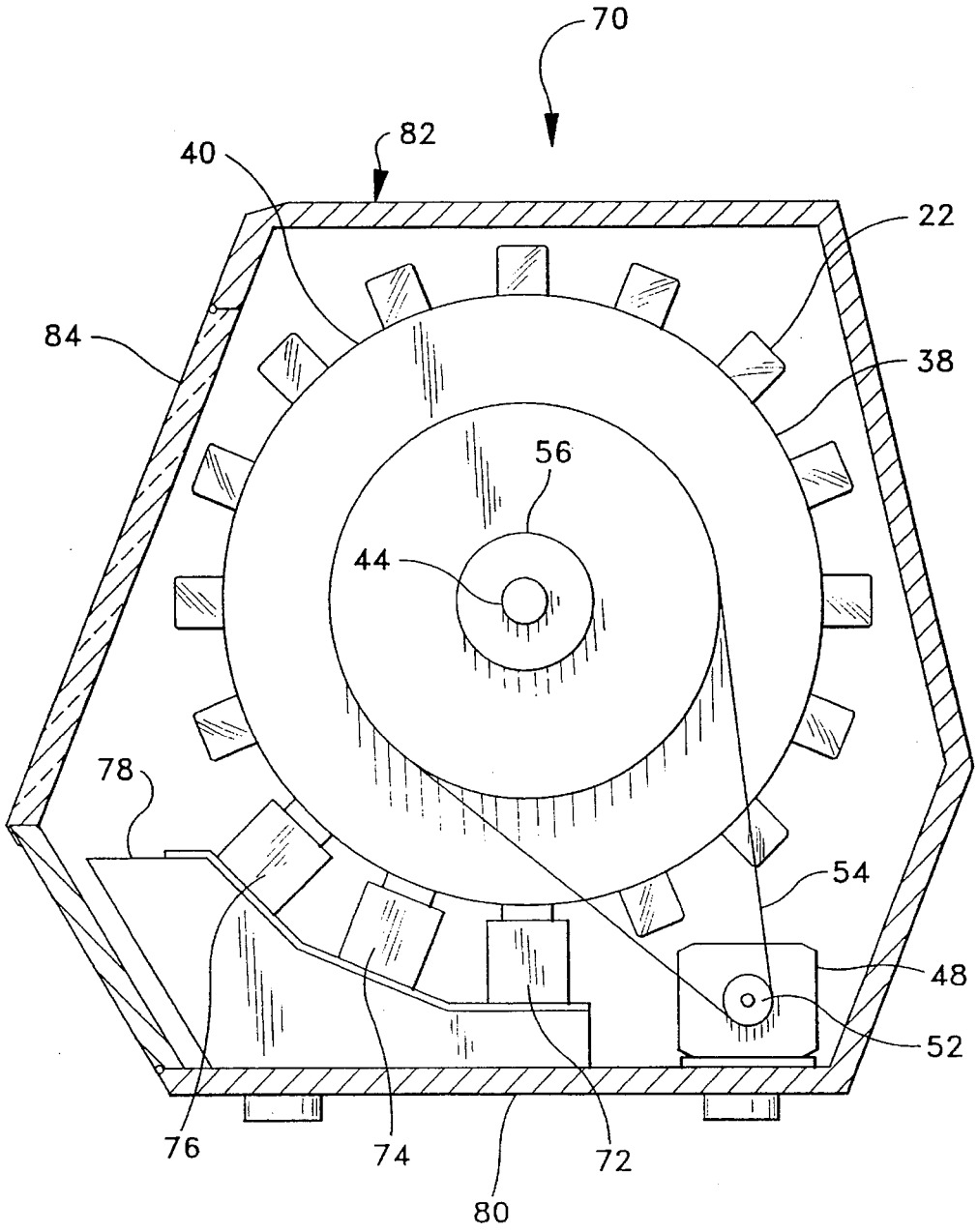
FIG. 2 depicts a side view of a compact blood culture apparatus according to the present invention, with an embodiment comprising sixteen vials on a disk-like drum segment, and with three sensor stations per segment.

FIG. 2 depicts a compact blood culture apparatus 70 according to the present invention. It includes sixteen vials 22 on each segment 38 and three sensor stations 72, 74, and 76 per segment. Sensor stations 72, 74, and 76 are mounted to a common baseplate 78, which in turn is secured to a mainframe 80 of apparatus 70. This allows for replacement of the sensors. Thus, the disclosed apparatus is flexible with regard to the application of alternative detection principles. Upgrading is accomplished easily by replacing whole sensor station blocks with new blocks.

Stepper motor 48, rotating drum 40, and baseplate 78 with the sensor stations are arranged within an incubator 82. Vial placement and removal is possible via a door 84.

Figure 3:
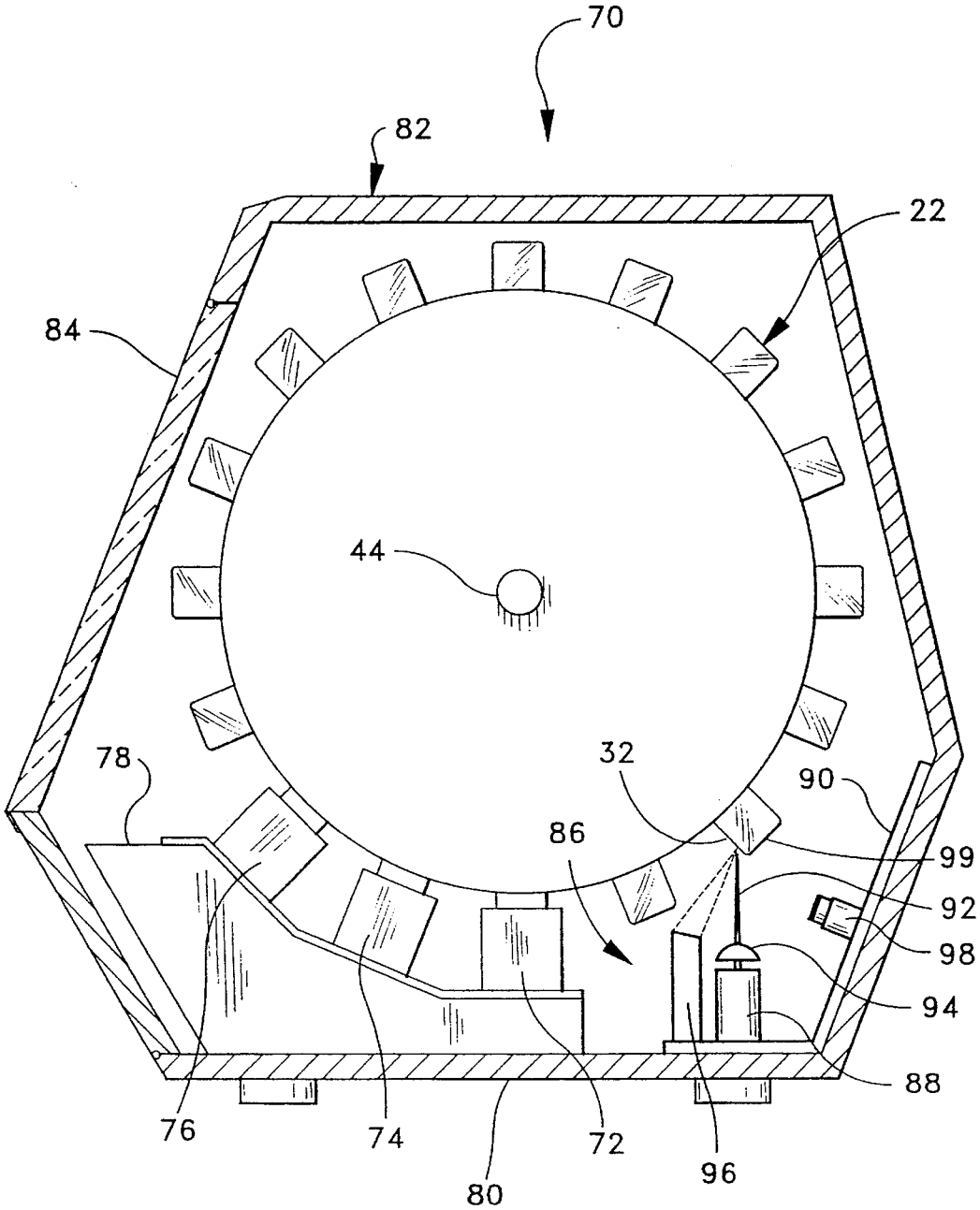
FIG. 3 shows a side view of a compact blood culture apparatus according to the embodiment of FIG. 2, and including a bar code reader per segment.

FIG. 3 shows blood culture apparatus 70 which includes a bar code reader 86 for each segment 38. To read labels 32, a diode laser 88 is mounted to a plate 90 which in turn is fixed to mainframe 80. This allows for easy insertion and replacement of the elements. A laser beam 92 is focused by a long-focal-length optical system 94 onto the bar code label 32 of a vial 22. An optimum angle of incidence is approximately 45 degrees. Laser light back-scattered from a label 32 is detected by means of a photodetector 96. During drum rotation, all vials 22 of a disk-like segment 38 pass by the focused diode laser beam 92, to allow for bar code read-out. An auxiliary photodetector 98 mounted to plate 90 receives a light pulse whenever a portion of a vial 22, and particularly the bottom 99, crosses beam 92. In this way, the presence of a vial in a station can be verified. It is also envisioned that auxiliary photodetector 98 with bar code reader 86 may be used as a supplement for or in place of encoder 56, shown in FIG. 1, as a location positioner for drum 40.

Figure 4:
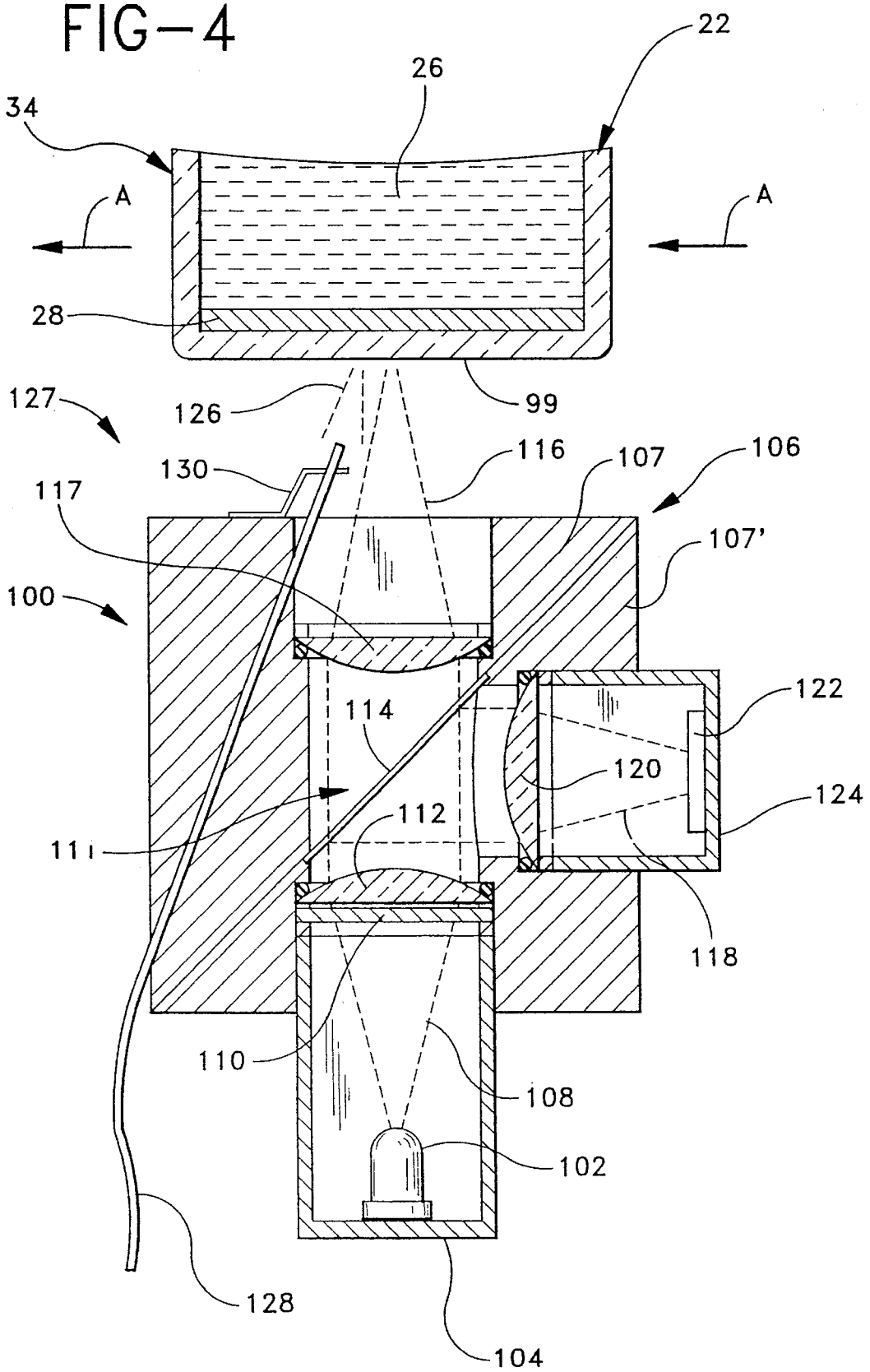
FIG. 4 is a schematic illustrating a first embodiment of a fluorescence sensor station.

FIG. 4 is a schematic illustrating the operation of a non-invasive fluorescence sensor station 100. Vial 22, with medium/blood mixture 26, moves in the direction indicated by arrows A. Fluorescence sensor station 100 comprises an excitation light source 102, most preferably a green LED. Sensor 28 is preferably particularly sensitive to green light. Source 102 is mounted within a light-tight cylinder 104, which is held in a block 106 comprising block sections 107, 107'. Block sections 107 and 107' allow assembly and disassembly of station 100. Excitation light 108 passes an excitation filter 110 into a condenser system 111. Excitation filter 110 is used because a green LED has a long wavelength tail of yellow and red light. Sensor 28 emits this same type of light when carbon dioxide from microorganism growth is detected. If filter 110 is not used, undesirable back-scattering results, reducing the accuracy of the sensor.

Condenser system 111 includes an optical condenser lens 112 and a beam splitter 114. Beam splitter 114 may simply be a glass plate with no spectral selective properties. If such a beam splitter is used, then approximately 95 percent of excitation light 108, component 116, is focused onto the bottom 99 of a vial 22 by means of an optical condenser lens 117. Beam splitter 114 also directs a component 118 of excitation light 108 through an optical condenser lens 120 onto a light source monitor such as photodiode 122 mounted within a second light-tight cylinder 124, which is also held in block 106. A light source will lose intensity over time. A light source monitor such as photodiode 122 can measure this reduction in intensity which may be used to calculate an accurate correspondence between fluorescence light 126 and excitation light 108. A portion of the fluorescence light 126 reemerging from the chemical fluorescent sensor 28 at bottom 99 is collected by a fluorescence light collector 127 including a collection fiber 128, held in position by a clamp 130.

Figure 5:
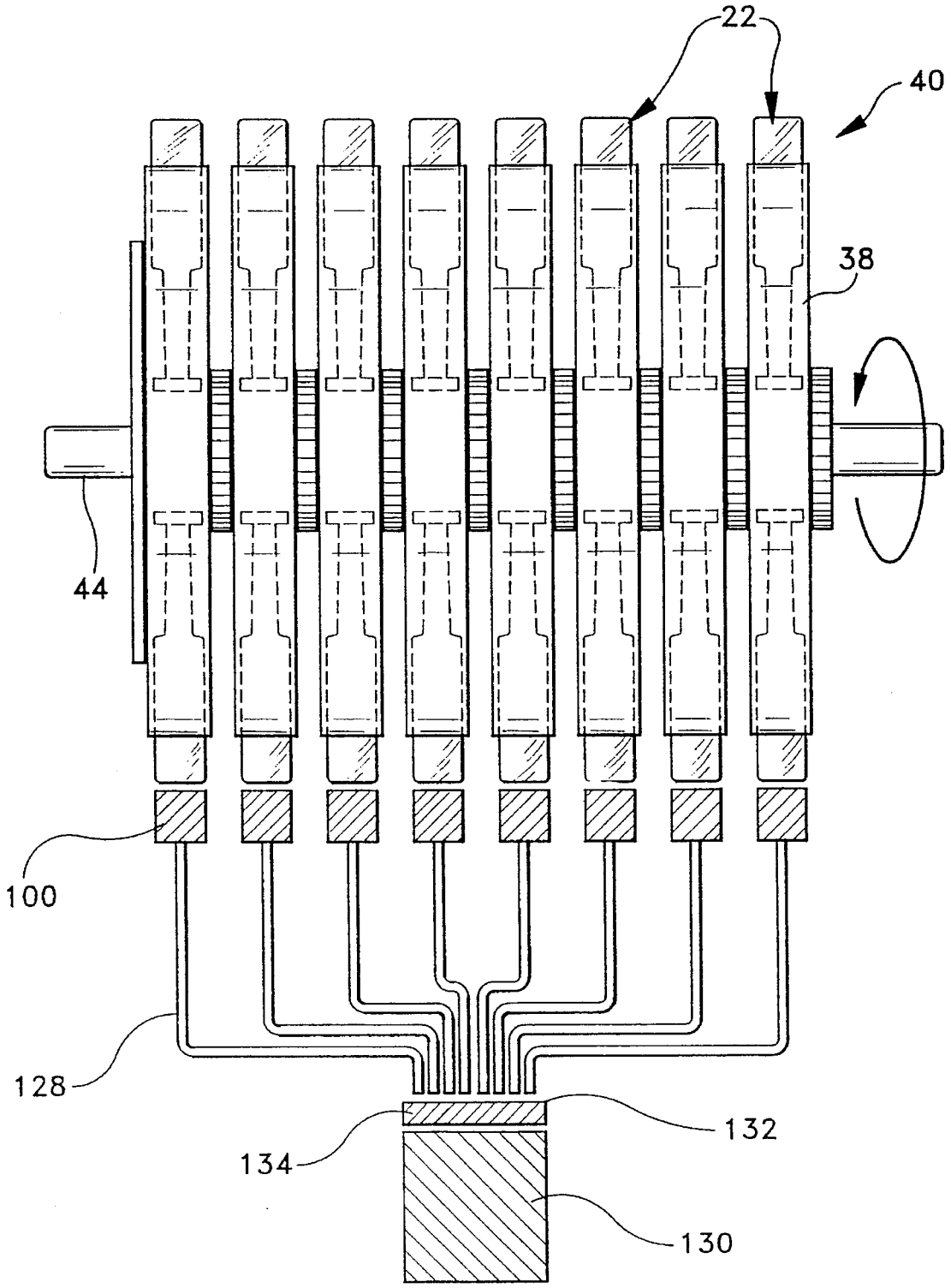
FIG. 5 is a schematic showing the use of a single photomultiplier for a plurality of sensor stations.

As shown in FIG. 5, the collection fibers 128 of all fluorescence sensor stations 100 are fed to central photomultiplier 130 with an emission filter 132 arranged in front of a photocathode 134. The fibers are used to transmit the fluorescence light to the photomultiplier. In practice, only one light source 102 is typically initiated at a time. By using a central photomultiplier, several advantages are achieved. First, a high-quality photomultiplier is economically feasible since it is used with a large number of vials. Further, when more than one emission filter or photomultiplier is used, errors propagate since the filters and photomultipliers are never identical to one another. In an apparatus according to the present invention, the quality of the quantitative analysis is greatly increased because only one arrangement must be calibrated.

Figure 6:
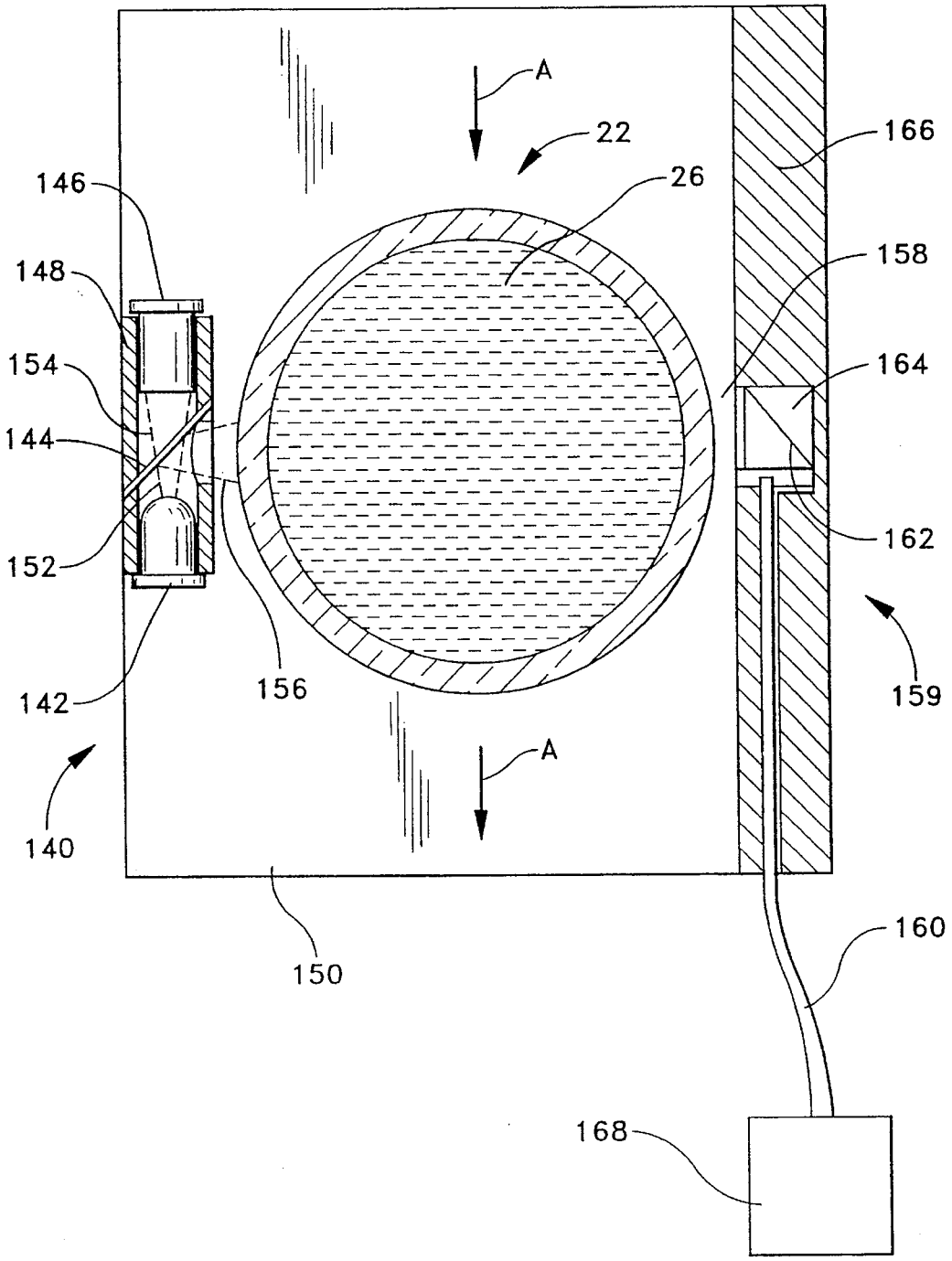
FIG. 6 is a schematic showing a sensor station for scattered photon migration.

FIG. 6 shows a non-invasive sensor station 140 for measuring scattered photon migration ("SPM"). Once again, vial 22, with medium/blood mixture 26 moves in the direction indicated by arrows A. Each SPM sensor station 140 comprises an excitation light source 142, preferably a red LED. SPM sensor station 140 also includes a beam splitter 144, and a monitor photodiode 146. The beam splitter and photodiode perform the same general functions as discussed above with respect to fluorescence station 100. Elements 142, 144, and 146 are mounted within a small block 148 which is fixed to a large block 150. Excitation light 152 from light source 142 is split into components 154 and 156. Component 154 directed to and measured by monitor photodiode 146 and component 156 is directed by beam splitter 144 into medium/blood mixture 26.

SPM light reemerging from vial side 158, opposite small block 148, is deflected toward a light gatherer 159. SPM light is transported using a collection fiber 160, a collection prism 162 being used to focus and redirect the light into the fiber. Prism 162 is located inside an opening 164 in a large plate 166, which is mounted to the large block 150. The small block 148 and the large plate 166 are arranged so that vial 22 can just pass between them. The collection fibers 160 of all SPM sensor stations 140 are fed to a second central photomultiplier 168. If the emission of the fluorescent chemical sensor 100, shown in FIG. 4, occurs at a wavelength close to the optimum SPM wavelength, then the collection fibers 160 of all SPM sensor stations can be fed to the central fluorescence photomultiplier 130, shown in FIG. 5. Only one photomultiplier is typically required.

Figure 7:
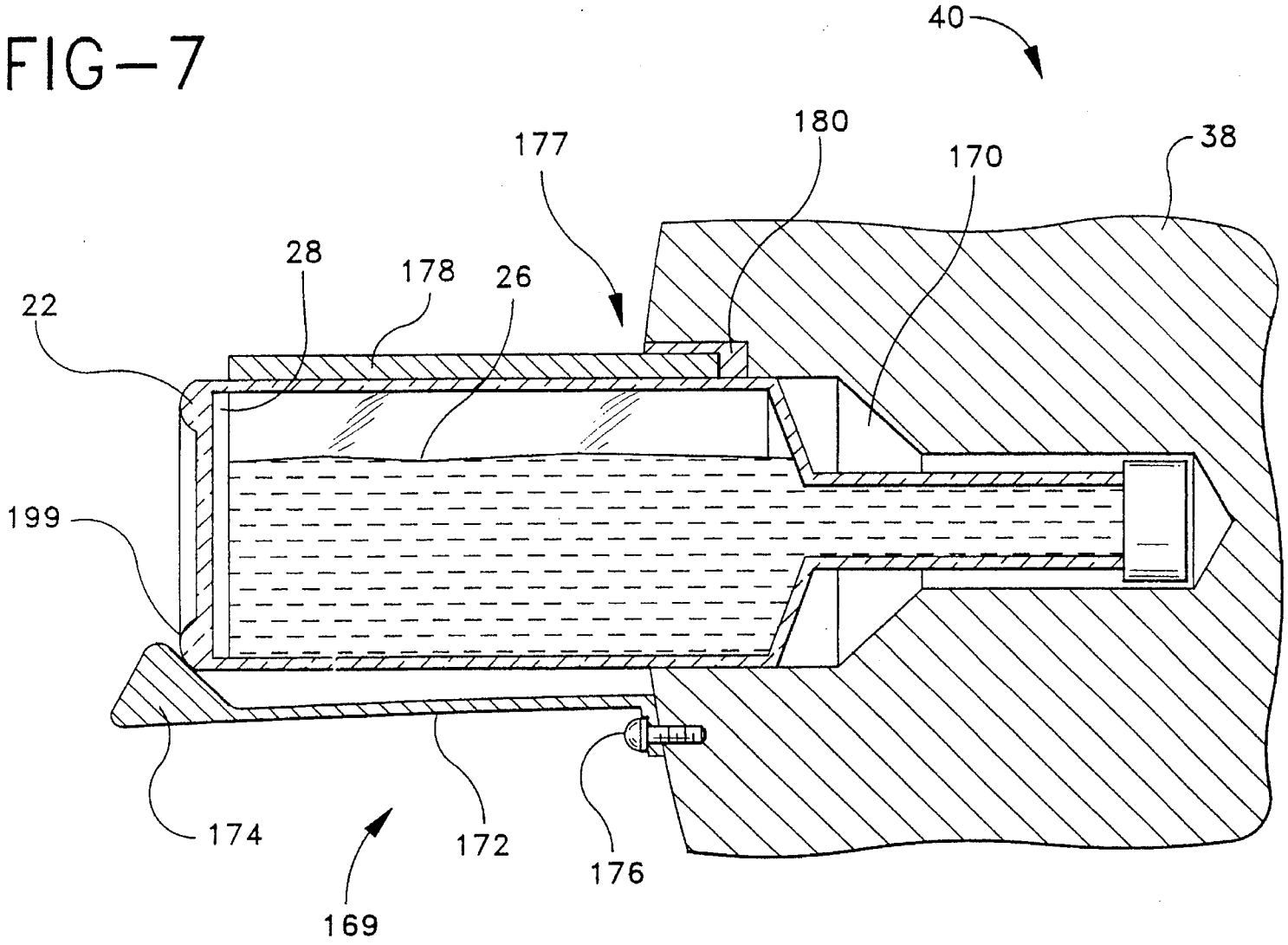
FIG. 7 illustrates one embodiment for placing vials within a disk-like segment of a drum.

FIG. 7 shows one preferred embodiment of a quick disconnect 169 for placing vials 22 within disk-like segments 38 of drum 40. A vial 22 is selectively inserted into a conical bore-hole 170 formed within segment 38. A spring-clip 172 with an integral latch 174 allows for easy snap-in handling of the vials. Clip 172 is secured adjacent to bore-hole 170 by an appropriate attachment means, such as a screw 176. Spring-clip 172 extends outwardly from segment 38 with integral latch 174 adapted to engage outer bottom surface 99 of vial 22. In operation, clip 172 is yieldably biased toward vial 22. By pivoting latch 174 about the point of clip attachment to segment 38, latch 174 disengagingly engages bottom 99 to allow vial insertion and removal.

A preferred embodiment of the present invention includes a keying mechanism 177 to place vials 22 in an optimum orientation for identification using label reader 86, as illustrated in FIG. 3. Vials 22 may include a linear bar code label 178 of a thick material, preferably of non-glossy white plastic. Label 178 fits into an appropriate opening 180 in drum segment 38, opposite from clip 172. By doing this, a vial 22 fits into bore-hole 170 only in one angular orientation. Thus, label 178 acts as a key to make sure that the vial is properly inserted so that the label may be read by the bar code reader. It should be recognized however, that a wide variety of keying mechanisms are possible, including the use of almost any protrusion of a vial in conjunction with an appropriate opening.

Figure 8:
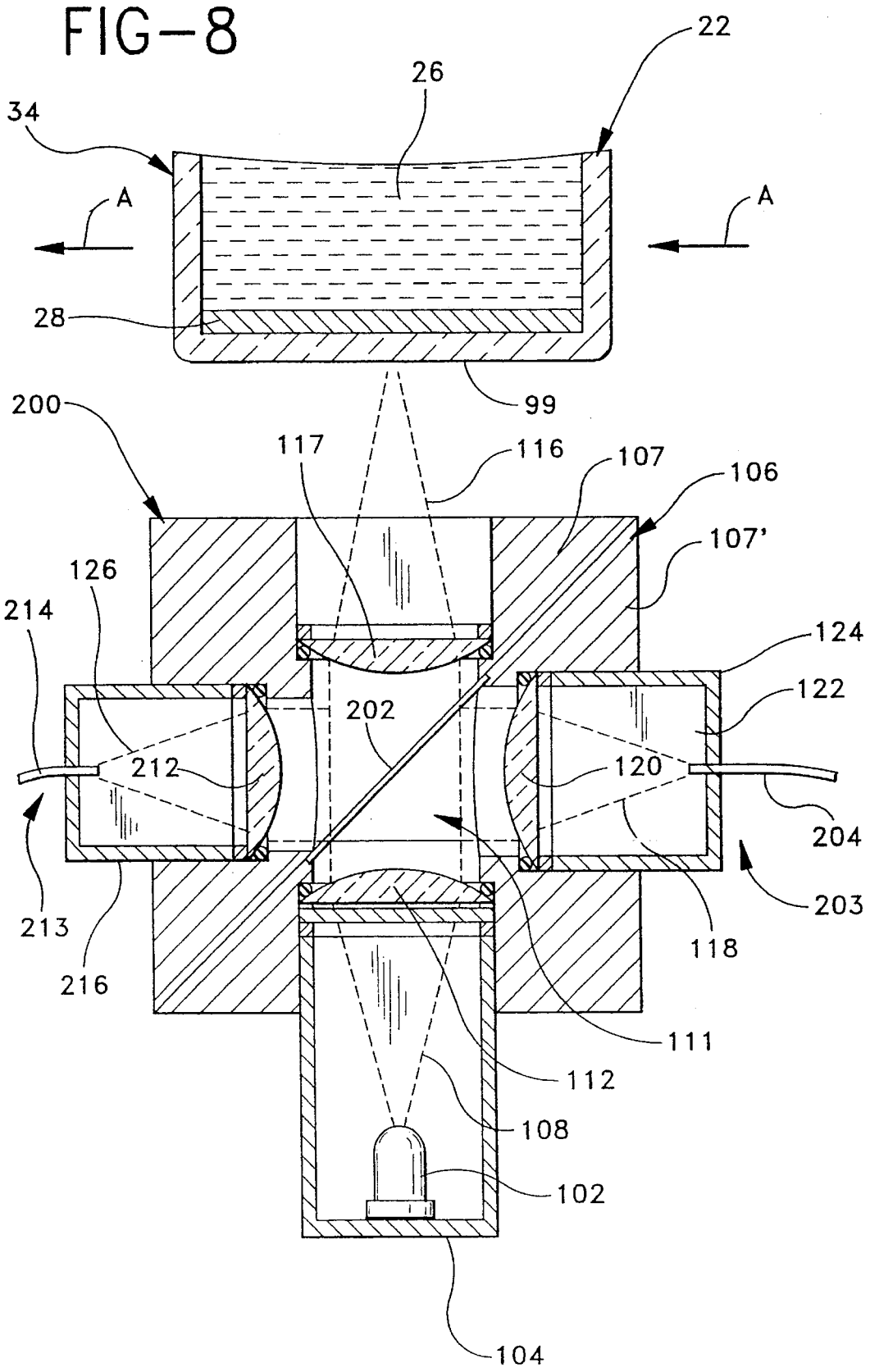
FIG. 8 is a schematic illustrating a second embodiment of a fluorescence sensor station.

FIG. 8 shows a second embodiment of a fluorescence sensor station 200. Station 200 is similar to sensor station 100, depicted in FIG. 4. The light divider represented by beam splitter 114 is replaced with a broadband interference filter 202 which is optimized for 45-degree beam incidence. Filter 202 is an alternative for excitation filter 110 since it only transmits short-wavelength excitation radiation such as the green light preferably emitted by light source 102. Filter 202 acts as a reflector at other wavelengths. In this way, most of excitation light 108 from source 102 reaches the chemical fluorescence sensor 28 at the inner bottom 30 of a vial 22. A small fraction of the excitation light 108, light 118, is reflected towards lens 120 which focuses the light onto a light source monitor 203, shown in greater detail in FIG. 9. Monitor 203 includes a collection fiber 204. If a green LED is used, this light is generally in the yellow and red wavelength range, although a portion of the excitation light is also reflected.

Figure 9:
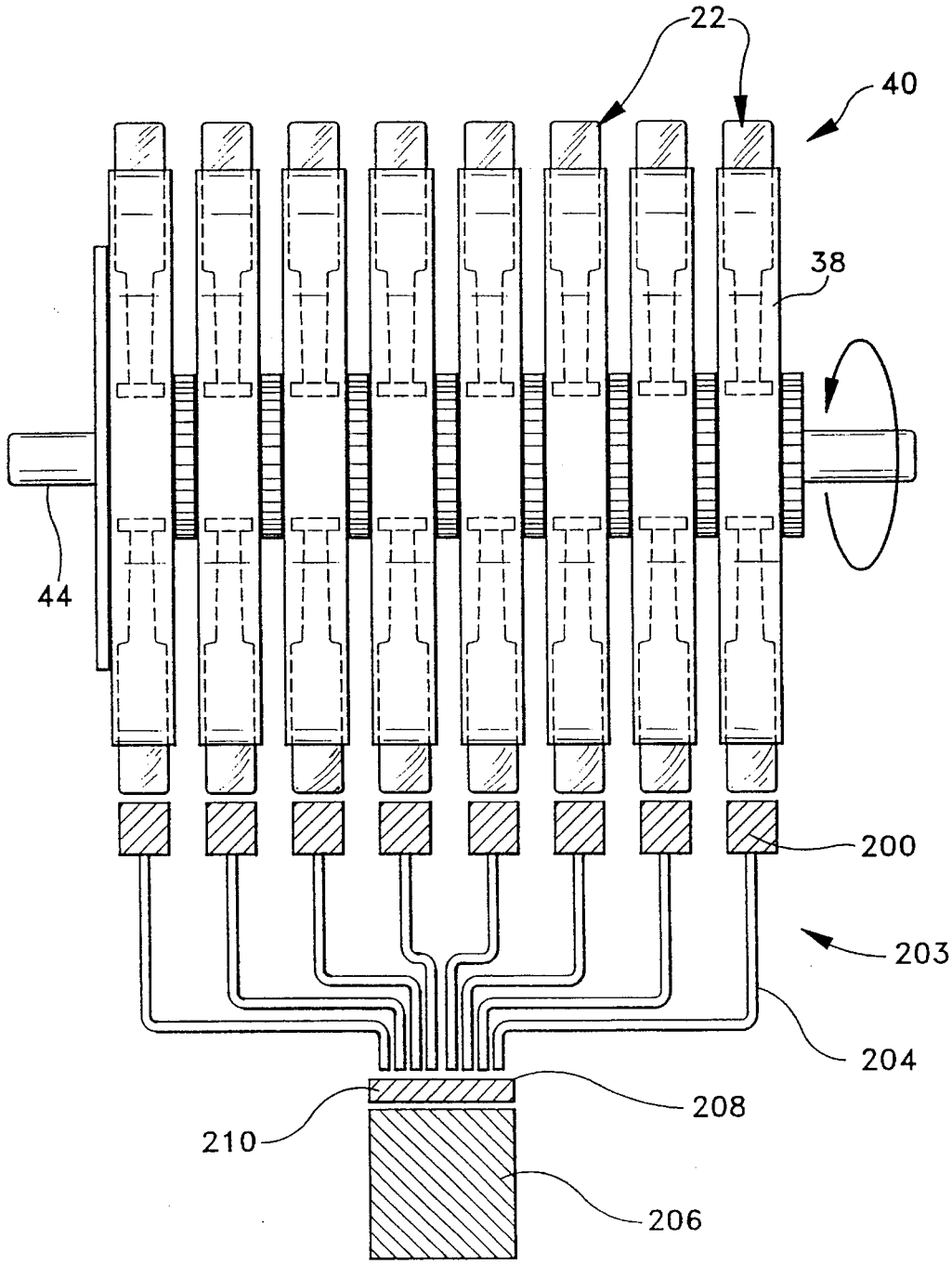
FIG. 9 shows the use of a single photomultiplier for a plurality of sensor stations with a light monitor according to the embodiment of FIG. 8.

As shown in FIG. 9, the collection fibers 204 of monitor 203 for each fluorescence sensor station 200 is fed to a single central source monitor photomultiplier 206 with an excitation filter 208 arranged in front of a photocathode 210. Excitation filter 208 is used to filter out the red and yellow light reflected by filter 202 so that an accurate measurement may be made of the portion of green light also reflected by filter 202. Thus, reductions in light source intensity may be more accurately measured.

Turning back to FIG. 8, a substantial part of the fluorescence light 116 reemerging from sensor 28 is collected by lens 117, and then reflected by interference filter 202 towards lens 212 which focuses light 126 into a fluorescence light collector 213 which includes a collection fiber 214 mounted in a light-tight cylinder 216. This light is reflected by filter 202 since it is in the yellow and red wavelength range, as discussed above. As in the embodiment of fluorescence sensor station 100, illustrated in FIG. 5, the collection fibers 214 of all fluorescence sensor stations 200 are fed to a central fluorescence monitoring photomultiplier 130 with emission filter 132 arranged in front of photocathode 134.

Figure 10:
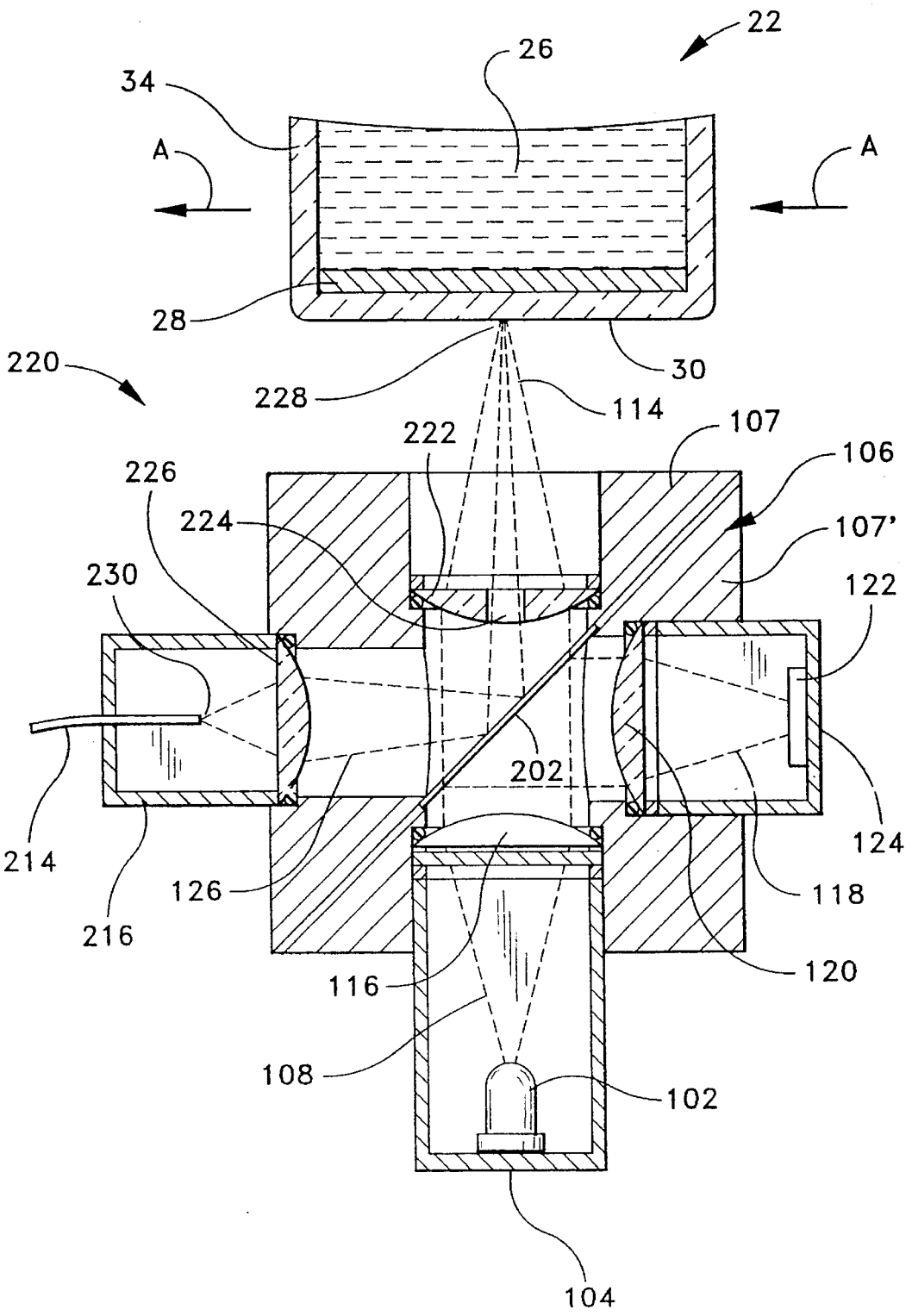
FIG. 10 is a schematic illustrating a third embodiment of a fluorescence sensor station.

FIG. 10 shows a third embodiment for a fluorescence sensor station 220. Station 220 is similar to sensor station 100 of FIG. 4 and sensor station 200 as depicted in FIG. 8.

Lens 222 with an axial bore-hole 224 is substituted for lens 117 of sensor station 200. Lens 226 in FIG. 10 is similar to lens 212 of FIG. 8, but has a shorter focal length, and is arranged at a greater distance from broadband interference filter 202. The collection fiber 214 is arranged so that an illuminated spot 228 at the bottom of a vial 22 is imaged onto the end face 230 of fiber 214. As in FIG. 4, a photodiode 122 is used to monitor the optical power emitted by source 102.

In operation, illuminated spot 228 is imaged onto the collection fiber 214 with fluorescence light 126 passing through bore-hole 224 without interacting with the rest of lens 222 and deflected by filter 202 through lens 226. By increasing the distance between the illuminated fluorescence sensor 28 and collection lens 226, in combination with the reduced focal length of lens 226, a significant image reduction at the collection fiber input of end face 230 is achieved. Under this imaging condition, the fluorescence output photocurrent, I, of the central photodetector is given by the following equation:

$$I = C\frac{A}{r^2}. \tag{1}$$

In Equation (1), C is a constant which takes into account such parameters as source intensity, filter transmission, or photodetector sensitivity. The quantity A is the collection area of lens 226, and r is the distance between the illuminated fluorescence sensor 28 and collection lens 226.

A major advantage of the sensor arrangement depicted in FIG. 10 is the fact that the photocurrent I is much less sensitive to vial displacement as compared to conventional sensor arrangements. This can be shown by calculating the relative error, dI/I, in the photocurrent, I, caused by a change, dr, in the sensor-detector distance, r. From equation (1) we obtain the following equation:

$$\frac{dI}{I} = -\frac{2}{r}\,dr. \tag{2}$$

In conventional sensor arrangements, r has a typical value of 1 cm. If we assume a vial distance change dr=1 mm, the resulting error in the photocurrent I is 20%. By increasing the vial distance according to the present invention, e.g. to r=12 cm, the error in I is reduced to only 1.7%. Accordingly, a vial displacement of 2 mm in a conventional sensor arrangement would result in a 40% error in I, while the same displacement in a sensor arrangement according to the present invention causes only a 3.4% error in I, achieved in disclosed embodiments.

The sensor arrangement according to FIG. 10 requires a high-sensitivity photodetector, such as a photomultiplier. In known automated blood culture systems with individual light sources and individual photodetectors, the usage of photomultipliers is impractical because of cost and calibration skew. Consequently, a short sensor-detector distance, typically about 1 cm, has to be maintained. As a matter of experience, this results in significant photocurrent variations due to vial displacement, vial shape variation, or detector displacement. In an apparatus according to the present invention, on the contrary, only one central photomultiplier is required. Consequently, the sensor arrangement of FIG. 10 can be used without difficulty.

Increasing the sensor-detector distance by a factor of 12 may appear to be contrary to common sense. However, reducing the requirement for exact vial positioning has two significant advantages. First, instrument performance can be improved by eliminating photocurrent errors due to vial position changes. Second, the instrument can be manufactured at lower cost due to the reduced positioning precision requirements.

Figure 11:
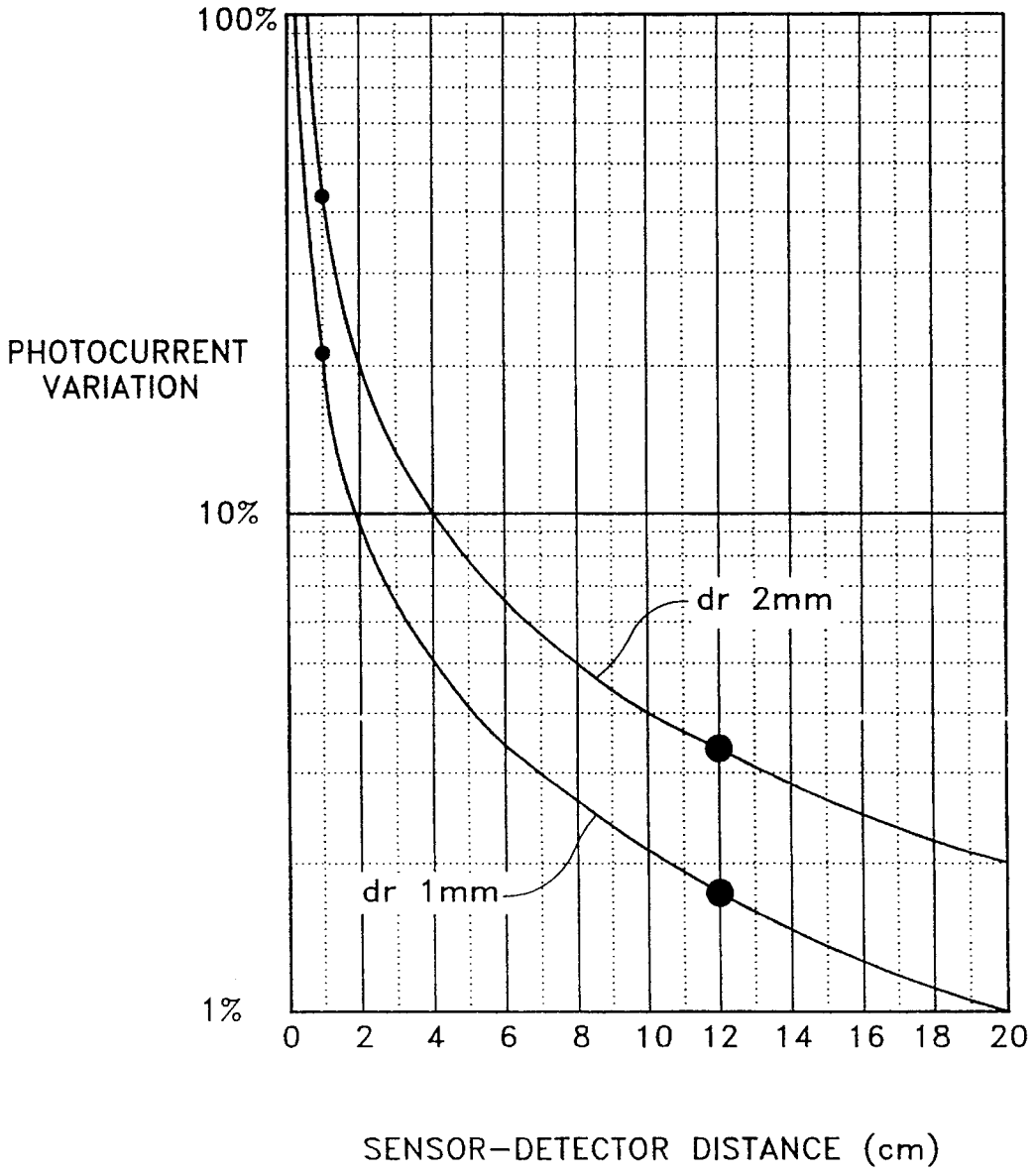
FIG. 11 illustrates the effect of sensor-detector distance variations (1 mm and 2 mm) on the measured fluorescence photocurrent. The calculated plots show the resulting photcurrent variation versus the sensor-detector distance.

FIG. 11 illustrates the advantage of a sensor arrangement according to FIG. 10 with an increased sensor-detector distance. For 1 mm vial displacement, the error in the photocurrent is 20% at a conventional sensor-detector distance of 1 cm, but only 1.7% at a distance of 12 cm. For 2 mm vial displacement, the error in the photocurrent is 40% at a conventional sensor-detector distance of 1 cm, and only 3.4% at a distance of 12 cm.

Thus, while preferred embodiments of the present invention have been described so as to enable one skilled in the art to practice the apparatus of the present invention, it is to be understood that variations and modifications may be employed without departing from the concept of the present invention as defined in the following claims. Accordingly, the proceeding description is intended to be exemplary and should not be used to limit the scope of the invention.

I claim:

1. A compact blood culture apparatus comprising:

a housing;

a plurality of vials;

a drum rotatably mounted in said housing and having an axis disposed therein at an angle relative to a force of gravity, said drum being rotatable about said axis and including means in said housing for rotating said drum about said axis;

means in said housing for detecting microorganisms within each of said plurality of vials in said drum using scattered photon migration;

means in said housing and on each vial for identifying each of said plurality of vials;

means in said drum for positioning each of said plurality of vials within a respective one of said plurality of bore-holes in an optimum orientation for identification by said identifying means; and agitation means in said housing for activating rotation of said drum about said axis to perform agitation on said plurality of vials; and said drum being constructed and arranged to simultaneously and continuously (i) move one of said plurality of vials through said detecting means and (ii) perform agitation on all of said plurality of vials when said drum is rotated about said axis.

2. A compact blood culture apparatus as recited in claim 1, wherein said axis is approximately perpendicular to said force of gravity.

3. A compact blood culture apparatus as recited in claim 1, wherein said drum further comprises a plurality of segments disposed about said axis, each of said segments having said bore-holes for receiving said vials.

4. A compact blood culture apparatus as recited in claim 3, wherein said drum further comprises a spacer disposed between two of said segments to separate them.

5. A compact blood culture apparatus as recited in claim 1, said vial identifier comprising:

a bar code label secured to an outer surface of each of the vials;

a laser adapted to project a beam of radiation;

optical system means in said housing for focusing said beam of radiation from said laser means on said bar code label; and a first photodetector in said housing for collecting a radiation back-scattered from said bar code label when said beam of radiation from said laser means is focused on said bar code label by said optical system means.

6. A compact blood culture apparatus as recited in claim 5, wherein said positioning means comprises a second photodetector positioned to receive said back-scattered radiation when a portion of each of the vials crosses said beam.

7. A compact blood culture apparatus as recited in claim 1, wherein each of said bore-holes is shaped to receive a neck of one of the vials.

8. A compact blood culture apparatus as recited in claim 1 wherein said positioning means comprises:

a protrusion on an outer surface of each of said vials, said protrusion being received within an opening in said respective bore-hole in said drum.

9. A compact blood culture apparatus as recited in claim 8, wherein said protrusion comprises a bar code label having a rectangular shape.

10. A compact blood culture apparatus as recited in claim 7, wherein each of said bore-holes includes a quick disconnect for engaging and disengaging a respective one of said vials.

11. A compact blood culture apparatus as recited in claim 10, wherein said quick disconnect comprises a spring-clip with latch, said clip being secured to and extending from said drum on an outer surface of said respective one of said vials when inserted into a respective borehole and said latch removably engaging an outer bottom surface of said respective one of said vials which extends out of said respective borehole.

12. A compact blood culture apparatus as recited in claim 1, wherein said mechanism for agitation comprises:

a shaft extending along said axis and secured to said drum; and a motor for driving said shaft to rotate said drum.

13. A compact blood culture apparatus as recited in claim 1, wherein said drum with said vials are mounted in an incubator to promote microorganism growth.

14. A compact blood culture apparatus as recited in claim 1, wherein said detecting means further comprises:

excitation light source means for emitting excitation light into each of said plurality of vials in said drum;

light divider means for dividing said excitation light into first and second components, and first component being used for monitoring said excitation light source and said second component being directed at one of said plurality of vials; and light source monitor for receiving and monitoring said first component of said excitation light.

15. A compact blood culture apparatus as recited in claim 14, wherein each of said plurality of vials further comprises a fluorescence chemical sensor disposed on an inner bottom surface thereof, and wherein said detecting means further comprises:

optical lens means for focusing said second component of said excitation light upon said fluorescence chemical sensor; and fluorescence light collector means for collecting a fluorescence light emitted from said fluorescence chemical sensor.

16. A compact blood culture apparatus as recited in claim 15, wherein said fluorescence light collector comprises:

collection fiber means for receiving a portion of said fluorescence light that reemerges from said fluorescence chemical sensor;

photomultiplier means for measuring said portion of said fluorescence light received by said collection fiber means; and emission filter means disposed between said collection fiber means and said photomultiplier means for eliminating unwanted light from reaching said photomultiplier means.

17. A compact blood culture apparatus as recited in claim 14, wherein said gathering means comprises:

collection prism means for focusing and redirecting said photon light;

photomultiplier means for measuring said photon light from said collection prism means; and collection fiber means disposed between said prism means and said photomultiplier means for transmitting said photon light to said photomultiplier means.

18. A compact blood culture apparatus comprising:

a housing;

a plurality of vials;

a drum rotatably mounted in said housing and having an axis disposed therein, said drum being rotatable about said axis and including a plurality of segments with a plurality of bore-holes formed within each of said segments, each of said bore-holes constructed and arranged to receive one of said plurality of vials;

means in said drum for positioning each of said plurality of vials within a respective one of said plurality of bore-holes in an optimum orientation for identification;

agitation means in said housing for activating rotation of said drum about said axis to perform agitation on said plurality of vials;

means in said housing for non-invasively detecting micro-organisms within each of said plurality of vials in each of said segments in said drum using scattered photon migration;

means on each vial for identifying each of said plurality of vials including a bar code label on an outer surface of each of said plurality of vials and label reader means in said housing for reading said bar code label; and said drum being arranged and constructed to simultaneously and continuously move (i) one of said plurality of vials through said detecting means to perform detection during rotation and (ii) perform agitation on all of said plurality of vials, when said drum is rotated about said axis.

19. A blood culture apparatus as recited in claim 18, wherein each of said plurality of vials further comprises a fluorescence chemical sensor disposed on an inner bottom surface thereof, and wherein said detecting means further includes:

collection fiber means for receiving a portion of a fluorescence light that reemerges from said fluorescence chemical sensor when reacting to an excitation light; and photomultiplier means for receiving and measuring said fluorescence light.

20. A compact blood culture apparatus as recited in claim 18, wherein said detecting means further includes:

excitation light source means for emitting an excitation light;

collection prism means for focusing and redirecting said excitation light through each of said plurality of vials;

collection fiber adapted to receive a portion of said excitation light exiting from each of said plurality of vials; and photomultiplier means for receiving and measuring said portion of said excitation light.

21. A compact blood culture apparatus as recited in claim 18, wherein said label reader means further comprises:

laser means for generating a beam of radiation;

optical system means for directing said beam on said bar code label; and a first photodetector for collecting a radiation back-scattered from said bar code label when said beam is directed on said bar code label.

22. A compact blood culture apparatus as recited in claim 21, wherein said positioning means comprises a second photodetector positioned to receive said back-scattered radiation when a portion of one of the vials crosses said beam.

23. A compact blood culture apparatus as recited in claim 22, wherein said second photodetector is positioned to receive said back-scattered radiation when a bottom outer surface of one of the vials crosses said beam.

24. A compact blood culture apparatus as recited in claim 22, wherein said laser means, said optical system means, said first photodetector, and said second photodetector are mounted to a common plate located on the bottom of said housing under said drum.

25. A compact blood culture apparatus as recited in claim 18, wherein said positioning means further includes:

a protrusion comprising said label and having a rectangular shape; and an opening in each of said bore-holes constructed and arranged to receive said protrusion.

26. A compact blood culture apparatus as recited in claim 18, wherein each of said bore-holes includes a quick disconnect for engaging and disengaging a respective one of said vials when inserted into a respective borehole, said quick disconnect comprising a plurality of spring-clips with an integral latch, each of said spring-clips being secured to said segments at each of said bore-holes and extending outwardly away from said segments so that said latch disengagingly engages an outer bottom surface of each of the vials which extends out of said respective borehole.

27. A compact blood culture apparatus as recited in claim 18, wherein said detecting means is secured to a baseplate located on the bottom of said housing under said drum.

* * * * *